United States Patent [19]

Robinson

[11] 4,297,051

[45] Oct. 27, 1981

[54] DEFORMABLE HIGHWAY MARKER

[76] Inventor: Jesse L. Robinson, P.O. Box 11544, Tahoe Paradise, Calif. 95708

[21] Appl. No.: 44,501

[22] Filed: Jun. 1, 1979

[51] Int. Cl.[3] ..... E01F 9/04

[52] U.S. Cl. ..... 404/11

[58] Field of Search ..... 404/11, 9, 15, 16; 116/63 R

[56] References Cited

U.S. PATENT DOCUMENTS

| | | | |
|---|---|---|---|
| 1,802,940 | 4/1931 | Cornelius | 404/15 X |
| 2,224,937 | 12/1940 | Stedman | 404/11 |
| 2,229,179 | 1/1941 | Langdon | 404/16 |
| 2,328,407 | 8/1943 | Becker | 404/16 |
| 2,434,103 | 1/1948 | Elliott | 404/15 |
| 2,627,784 | 2/1953 | Pellar | 404/16 |
| 2,635,513 | 4/1953 | Batterson | 404/15 |
| 2,703,038 | 3/1955 | Shaw | 404/16 |
| 3,216,335 | 11/1965 | Stolarczyk | 404/11 |
| 3,332,327 | 7/1967 | Heenan | 404/16 |
| 3,920,348 | 11/1975 | Paulos | 404/11 X |

FOREIGN PATENT DOCUMENTS

| | | | |
|---|---|---|---|
| 738993 | 10/1955 | United Kingdom | 404/11 |

*Primary Examiner*—Nile C. Byers, Jr.

*Attorney, Agent, or Firm*—Owen, Wickersham & Erickson

[57] ABSTRACT

A roadway marker, as for division of traffic lanes, has a flexible plastic dome-shaped top which extends above the roadway surface and is elastically deformable when run over by a snowplow blade. The marker is thus capable of use in all types of climate. A generally cylindrical skirt portion extends downwardly from the dome-shaped top and a ring-shaped flange is provided at the bottom of the skirt portion. The marker is placed in a bore formed in the roadway surface, such that the peripheral edge of the top is flush with the surface, and a grouting or similar material is applied to anchor and seal the marker within the bore, preferably such that air is sealed within the interior of the marker. The marker top may be made reflective by encapsulating an omni-directional reflective material just under the surface, in the molding process.

12 Claims, 6 Drawing Figures

FIG. 1
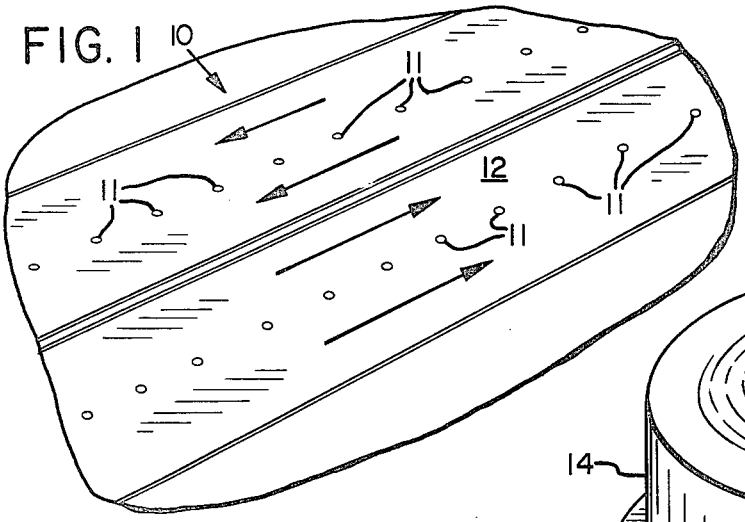
FIG. 2
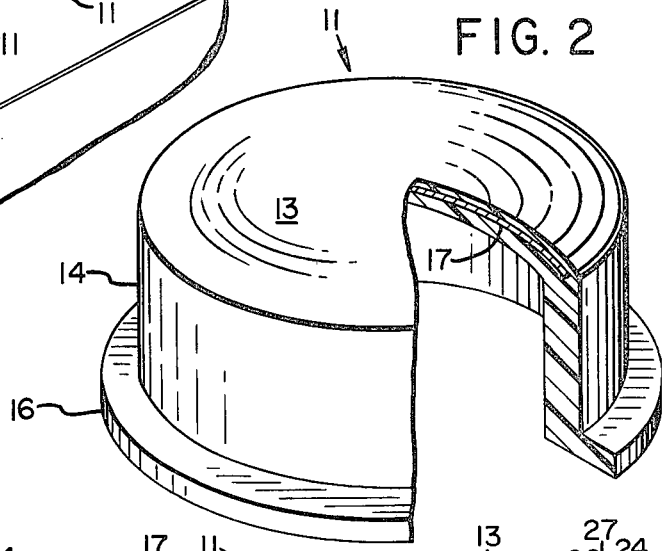
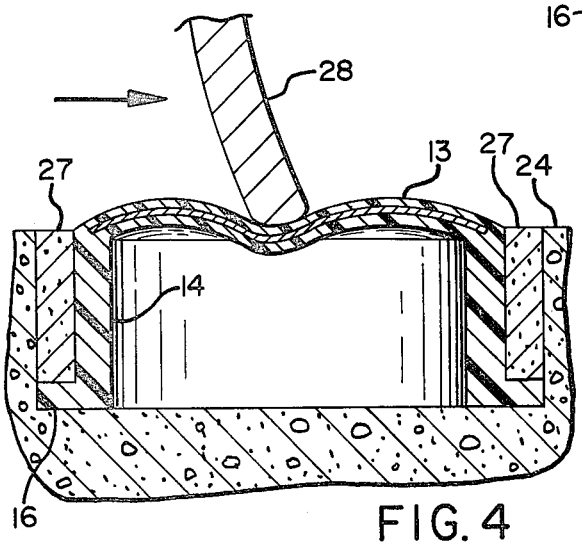
FIG. 4
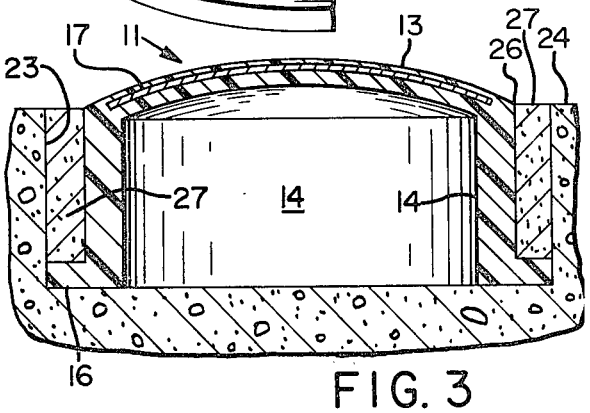
FIG. 3
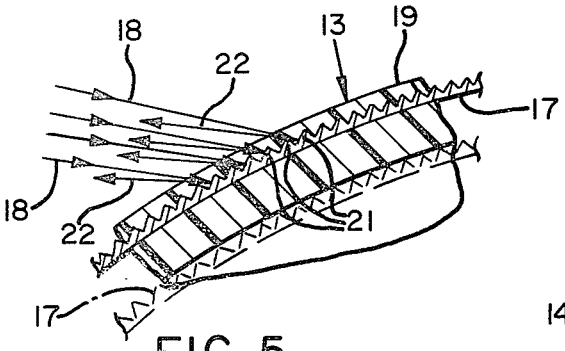
FIG. 5
FIG. 6
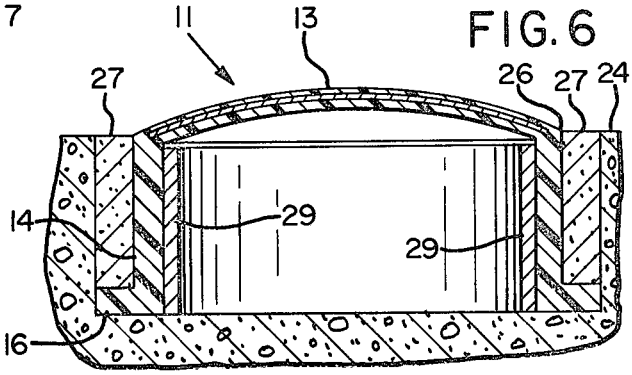

DEFORMABLE HIGHWAY MARKER

BACKGROUND OF THE INVENTION

The invention is concerned generally with roadway delineating apparatus, and more particularly with an improved raised-type marker particularly for separating traffic lanes, and capable of being struck by a snowplow blade without damage to the marker or the blade.

In areas which receive little or no snowfall, it is common for highways and other roadways to include series of "bumps" on the surface of the roadway, particularly between lanes. These raised markers, usually white or yellow, are highly visible in daytime and somewhat visible at night. They often comprise shallow ceramic domes, approximately four inches in diameter and flat-bottomed, adhered to the pavement surface by special epoxy cements. The use of the markers often eliminates the need for painting and repainting lane divider stripes on the roadway surface. However, to enhance the visibility of the dividing line in the daytime and particularly at night, usually special markers are interspersed with the dome-shaped bumps, often every fifth marker or so. These special markers are higher angularly shaped rigid structures, usually of plastic, having reflectors oriented toward the traffic, so that the dividing line is more brightly reflective, especially in the dark. The dome-shaped markers, though white, simply do not have sufficient reflective capability at night to be used alone.

Batterson U.S. Pat. No. 2,635,513 shows a traffic marker having a top of the general shape discussed, although the marker has a lower portion designed to be set into a bore or recess in the pavement. The Batterson marker is formed of a hard, non-elastic plastic material, and is to be filled internally with a grout material.

The principal problem with these roadway markers, or traffic "bumps", has been that they are useful only in areas receiving no appreciable snow in winter. The blades of snowplows clearing the road in winter would tear the markers loose, or the roadway simply could not be cleared. There have been a number of attempts to solve this problem. One attempted solution was to protect roadway reflectors with tapered, elongated risers positioned on either side of one or several markers, such that a snowplow blade moving in the direction of traffic would be lifted over the marker and lowered back to the surface, over a distance of a foot or so. Besides being large and expensive, another problem with these marker protectors was that they caused the snowplow to do an incomplete job of snow removal.

Other attempted solutions have taken the form of flexible or retractable markers. For example, see U.S. Pat. Nos. 1,885,941, 3,216,335, 3,901,614, and 3,920,348. None of these patents discloses a dome-shaped top which is itself deformable to accommodate a snowplow blade. Stolarczyk et al U.S. Pat. No. 3,216,335 shows a marker which is implanted in the roadway surface and has a multi-faceted, peaked top portion within which reflectors are positioned, oriented toward the approaching traffic. Besides the reflectors, the marker of that patent is comprised of a number of separate components, and thus would be fairly complex and expensive to manufacture and install. In addition, the peaked top portion with its planar sides and angled corners would last only a very short time under the punishment of a snowplow blade. The device has never been widely used on public roadways.

The remaining patents cited above show several forms of retractable marker bodies which are stated to actually recede into the pavement when struck, and they also disclose types of reflectors.

Past attempts to solve the problem of providing a flexible roadway marker useful in snowy areas simply have not been successful. Until the present invention, no suggested marker has presented a practicable and economic means for enabling the use of traffic "bumps" where snowplows are used.

SUMMARY OF THE INVENTION

The present invention provides a practical and efficient solution to the long-standing problem of providing a plowable highway marker. The marker of the invention is designed to be set into a bore in the roadway pavement, with a generally cylindrical body or skirt portion extending below the surface and a shallow dome-shaped top portion protruding above the surface. The marker is of a unitary, integrally molded construction of a relatively flexible and resilient plastic material such as dense polyurethane. At the bottom of the skirt portion is preferably included a flange extending radially outwardly, aiding in the retention of the marker body in the pavement bore, which is filled around the marker with a grout or similar material.

The molded plastic material may be of any desired color, and in many instances would be white or yellow. However, it is desirable to have the marker top highly reflective for increased visibility of the roadway dividing line both in daylight and at night. If the marker is adequately reflective, the larger, intermittently spaced reflecting structures discussed above can be eliminated, and the marker is then more appropriate for use in snowy areas.

The marker of the invention is made reflective by the inclusion of a "retroreflective" material just below the surface of the dome-shaped top, mold-encapsulated therein, or positioned inside the marker, against the underside of the relatively thin, dome-shaped top. Such a retroreflective material is shown for example, in U.S. Pat. No. 3,684,348 to Rowland. The retroreflective material of that patent consists of a sheet of material having a series of very small reflective peaks, thus providing for reflection of light from headlamps back toward the source, even though they strike the top of the marker at a very low angle, or a large apparent angle of incidence with respect to the marker surface. When such a material is encapsulated just below the surface of a marker made of substantially clear plastic material, the marker becomes reflective from nearly any angle.

The dome-shaped top of the present highway marker will deflect downwardly when run over by the blade of a snowplow, then return to its original position through the resiliency of the material. Such deflection has a tendency to pull inwardly on some portions of the sides, below the pavement, and this would permit the top to deform irregularly. If such irregular deformation is permitted to occur repeatedly, creases will form in the top portion and it will be quickly disintegrated by snowplow blades. If a very uneven, sharply creased deformation is permitted to occur, it can even result in shearing apart of the top portion in a single pass of a snowplow blade. Therefore, it is important that the generally cylindrical sides, or skirt portion, be reinforced to be of adequate stiffness to prevent the pulling of the sides inwardly. This can be accomplished by the inclusion of an annular rigid spacer device positioned to closely fit the interior of the skirt portion. This spacer may be of any rigid material such as metal or a rigid plastic, and it may be a narrow ring near the top of the interior of the marker or a cylindrical sleeve which matches the inside dimensions of the skirt portion. Alternatively, the skirt portion or sides may simply be made of sufficient thickness, heavier than the top portion, to provide the required resistance to buckling.

The roadway marker is preferably installed with a grout-like material which not only anchors and permanently secures the marker in place, but also makes it air tight. Thus, ambient air pressure existing at the time the marker is installed is maintained within the marker, and the compression of the air by snowplow blades and automobile tires, and the subsequent expansion of the air assist in returning the marker to its original configuration. The sealing of the marker also helps prevent the intrusion of dirt, moisture and other foreign elements.

Accordingly, in one embodiment of the invention a deformable highway marker for use in areas wherein snowplows are used to clear the roadway in winter comprises a flexible, resilient plastic skirt portion of a rounded shape, having substantially vertical walls, for being implanted below the surface of the roadway with the top of the walls generally flush with the surface of the roadway; and a rounded, generally dome-shaped deformable top of the same material, integrally molded with the skirt portion and free of angled corners and planar surfaces, for extending above the roadway surface as a visible marker for traffic on the roadway.

It is therefore among the objects of the invention to provide a plowable roadway marker which extends above the surface of the roadway, preferably including a retroreflective material or other such device rendering the dome-shaped top portion highly reflective in nearly all directions. These and other objects, advantages and features of the invention will be apparent from the following description of a preferred embodiment, taken in conjunction with the appended drawings.

DESCRIPTION OF THE DRAWINGS

FIG. 1 shows a highway in which deformable highway markers according to the invention are installed.

FIG. 2 is a perspective, partially broken-away view showing the roadway marker before installation, and indicating a reflective material which may be encapsulated beneath the surface of the marker's top portion.

FIG. 3 is a sectional elevational view showing the marker device installed in a roadway pavement, with only the dome-shaped top portion extending above the surface.

FIG. 4 is a view similar to FIG. 3, but demonstrating the downward deflection of the top portion under a snowplow blade.

FIG. 5 is an enlarged fragmentary view in section showing the reflection of a headlight beam from the roadway marker back toward the source.

FIG. 6 is a sectional view showing the roadway marker with a rigid internal reinforcing sleeve which may be incorporated for preventing buckling of the sides during top deformation.

DESCRIPTION OF A PREFERRED EMBODIMENT

In the drawings, FIG. 1 shows a multiple-lane highway or roadway 10 having series of deformable roadway markers 11 according to the invention implanted in the roadway surface 12. The markers 11 are spaced apart typically, similarly to the surface-adhered type markers which have previously been in common use.

FIG. 2 shows a marker 11 of the invention prior to installation. It includes a top portion 13 of a smoothly rounded, generally dome-like shape connected to a side or skirt portion 14 which extends generally vertically downward to a bottom flange 16 extending outwardly. The entire marker is preferably integrally molded, and may be formed of any strong, durable, tough and yet somewhat flexible material, such as a dense polyurethane. As discussed previously, the rounded top 13 is preferably highly reflective of light striking it from nearly any angle, even a low angle as from automobile headlights. Thus, the marker top reflects light approaching from a large apparent angle of incidence with respect to the top surface. This omni-reflective effect may be achieved by the encapsulation of a "retroreflective" material 17 just below the surface of the top portion 13 during the molding process. The material from which the marker is made is preferably clear or substantially clear, so that it is quite light transmissive. Thus, referring also to FIG. 5, approaching light rays 18 enter through the thin outer layer 19 of the top 13 at a low angle, strike reflective elements 21 of the retroreflective material 17, and are reflected back through the thin covering 19 and back toward the source, as indicated by the reflected ray 22. The term "retroreflective" material is intended to mean any material, whether in sheet form or in the form of a coating applied wet, which has the capability of reflecting light back toward the source even when the light approaches the material at an apparently low angle to the surface of the material (large apparent angle of incidence). The product disclosed in the above-referenced U.S. Pat. No. 3,684,348 is one example of such a retroreflective material which can be used advantageously in connection with the present invention. A product marketed by Minnesota Mining and Manufacturing Co. under the name "Scotchlite" is also suitable. Both these retroreflective materials are effective to reflect daylight toward the approaching traffic, as well as headlights at night. Another product of 3M Company known as "7610" is suitable as as retroreflective material at night, but is not as reflective by day as the other listed examples. However, in some situations it may be desirable to have certain markers which are highly reflective at night, but not so in daylight.

As illustrated in dashed lines in FIG. 5, the retroreflective material 17 may alternatively be placed inside the marker interior, against the underside of the top portion 13, provided the top portion is sufficiently thin and light transmissive.

FIG. 3 shows an installation of a deformable roadway marker 11 within a bore 23 in a roadway surface 24. The bore 23 may be drilled into pre-existing pavement or may be formed during paving. It should be relatively flat-bottomed, and of large enough size to accommodate the body of the marker 11, with its protruding bottom flange 16. The depth of the bore 23 may be formed precisely such that the peripheral top edge or shoulder 26 of the marker is substantially flush with the roadway surface 24 as shown, or the height of the marker may be adjusted within the bore through the use of grouting material. At any rate, a type of grouting material 27 preferably is used around the periphery of the skirt portion 14 to hold the marker 11 in place in the bore. The marker is hollow, and as discussed above, the grouting preferably is of a type capable of substantially sealing the interior of the marker, making it air tight and preventing the intrusion of dirt, moisture and other foreign substances. Moisture in particular, could cause damage through freezing and thawing. This also has the effect of helping the marker top 13 return to its original configuration after being deflected downwardly.

FIG. 4 shows the marker top 13 being deformed, i.e. deflected downwardly, by a snowplow blade 28. As indicated, the top deforms vevenly and generally symmetrically, with no corners, angles or sharp curves in the top to be damaged by the blade. The material used in the marker 11 is resilient, with a strong tendency to return to its original molded shape, which it does after the roadway scraping blade 28 has passed.

FIG. 6 shows an interior stiffening ring or sleeve 29 which may be used to maintain the shape of the wall or skirt portion 14 of the marker, preventing its pulling or buckling inwardly when the top 13 is forced downwardly. This structure can take the form of a rigid sleeve 29 of the full height of the wall 14, as shown, or it can be a shorter sleeve or rigid ring positioned interiorally near the top of the wall or skirt 14 (not illustrated). At the bottom, the flange 16 provides considerable rigidity.

As discussed above, if the skirt 14 is not reinforced, it will tend to pull inwardly with top deformation, permitting the top to take an irregular, "wrinkled" shape when run over by the blade 28, tending to result in the shearing-off or disintegration of the top portion 13. The reinforcing sleeve or ring 29 adds sufficient rigidity to the top portion of the wall or skirt 14 to prevent it from pulling in at any point around the periphery. However, this can also be accomplished through the molding of the skirt 14 in a thickness greater than that of the top 13, at least near the top of the skirt, so that the plastic material itself has sufficient rigidity in this area.

The deformable roadway marker 13 has been illustrated herein as substantially circular, with a cylindrical skirt portion 14. However, it may be formed in an elongated, oval or eliptical shape if desired, so long as the dome-shaped top 13 remains generally smooth and without sharp breaks or angles. Thus, the terms "dome-shaped" and "rounded" as used herein and in the appended claims are not intended to be restricted to circular forms, nor to absolute roundness of the top surface. Shallow flats in the surface can be tolerated.

The above described preferred embodiment provides a deformable roadway marker having the important advantages of flexibility, durability and visibility, enabling its use in snowy areas where rigid markers would prevent clearing of the road. Various other embodiments and modifications to this preferred embodiment will be apparent to those skilled in the art and may be made without departing from the spirit and scope of the invention as defined by the following claims.

I claim:

1. A deformable highway marker, comprising:

a flexible, resilient plastic generally cylindrical skirt portion for implanting in the pavement of a roadway with the upper periphery of the skirt portion generally flush with the roadway surface;

a rounded, dome-shaped deformable top portion of the same material, free of angled corners and sharp breaks and integrally molded with the skirt portion, for extending above the roadway surface to provide a visible marker for traffic on the roadway, the top portion being of resilience and deformability such as to be readily deformable downwardly into the space encompassed by the skirt portion under the weight of a snowplow blade on the road; and reflecting means associated with the top portion for reflecting daylight in the direction of the approaching traffic and also reflecting light from traffic headlamps back toward the source;

whereby the marker's top portion will deflect downwardly when struck by the blade of a snowplow and will quickly return to its original configuration.

2. The deformable highway marker of claim 1, further including a flange at the bottom of the skirt portion, extending generally radially outwardly, for helping retain the marker in place in the roadway pavement.

3. The deformable highway marker of claim 1, further including skirt stiffening means comprising a greater wall thickness in the skirt portion than in the top portion, for preventing collapse of the skirt when the top portion is deformed downwardly.

4. The deformable highway marker of claim 1, further including skirt stiffening means comprising a separate annular component of rigid material assembled within the skirt portion, closely fitted to the interior of the skirt portion, for preventing collapse of the skirt when the top portion is deformed downwardly.

5. A deformable roadway marker for use in areas wherein snowplows are used to clear the roadway in winter, comprising:

a flexible, resilient plastic skirt portion of a rounded shape, having substantially vertical walls, for being implanted below the surface of the roadway with the top of the walls generally flush with the surface of the roadway; and a rounded dome-shaped deformable top of the same material, integrally molded with the skirt portion and free of angled corners and sharp breaks, for lying generally flush with the roadway surface at its periphery, where it meets the skirt portion and for extending above the roadway surface as a visible marker for traffic on the roadway, the top portion being of resilience and deformability such as to be readily deformable downwardly into the space encompassed by the skirt portion under the weight of a snowplow blade on the road.

6. The roadway marker of claim 5, further including means associated with the top for reflecting light from traffic headlamps back toward the source, even though the angle of incidence of the light with the top surface is large, and also for reflecting daylight in the direction of the approaching traffic.

7. The roadway marker of claim 5, wherein the skirt portion is generally cylindrical and the top is shaped generally in the form of a portion of a sphere.

8. The roadway marker of claim 5, further including an outwardly extending flange at the bottom of the skirt portion for helping retain the marker in place in the roadway pavement.

9. A deformable roadway marker installation, comprising;

a bore in the roadway pavement;

a flexible, reslient plastic skirt portion of a rounded shape, having substantially vertical walls, positioned in the bore below the surface of the roadway, with the top of the walls generally flush with the surface of the roadway;

a rounded dome-shaped deformable top of the same material, integrally molded with the skirt portion to form a unitary marker structure, said top being free of angled corners and sharp breaks, meeting the skirt portion walls at a peripheral edge generally flush with the roadway surface and extending above the roadway surface as a visible marker for traffic on the roadway, the top portion being of resilience and deformability such as to be readily deformable downwardly into the space encompassed by the skirt portion under the weight of a snowplow blade on the road; and grout means retaining the roadway marker in position and sealing its interior such that air is substantially prevented from escaping the interior;

whereby the marker's top will deflect downwardly when struck by the blade of a snowplow and will quickly return to its original configuration, aided by the compression and re-expansion of the air in the interior.

10. The deformable roadway marker installation of claim 9, further including an outwardly extending flange at the bottom of the skirt portion for helping retain the marker in place in said grout means and cooperating with the grout means to seal the interior of the marker.

11. The deformable roadway marker installation of claim 9, further including means associated with the top for reflecting light from traffic headlamps back toward the source, even though the apparent angle of incidence of the light with the top surface is large.

12. The deformable marker of any of claims 1, 5 or 9, being integrally formed of dense polyurethane.

* * * * *